US007020424B2

(12) United States Patent
Gilmore et al.

(10) Patent No.: US 7,020,424 B2
(45) Date of Patent: Mar. 28, 2006

(54) BACKUP BELT ASSEMBLY FOR USE IN A FUSING SYSTEM AND FUSING SYSTEMS THEREWITH

(75) Inventors: James D. Gilmore, Lexington, KY (US); John W. Kietzman, Lexington, KY (US); Michael D. Maul, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 116 days.

(21) Appl. No.: 10/766,767

(22) Filed: Jan. 28, 2004

(65) Prior Publication Data

US 2005/0163542 A1 Jul. 28, 2005

(51) Int. Cl.
*G03G 15/20* (2006.01)

(52) U.S. Cl. ..... 399/329

(58) Field of Classification Search ..... 399/329, 399/165; 219/216

See application file for complete search history.

(56) References Cited

U.S. PATENT DOCUMENTS

| | | | | |
|---|---|---|---|---|
| 3,637,976 | A | 1/1972 | Ohta et al. | |
| 3,948,214 | A | 4/1976 | Thettu | |
| 4,378,152 | A | 3/1983 | Edwards et al. | |
| 4,567,349 | A | 1/1986 | Henry et al. | |
| 4,582,416 | A * | 4/1986 | Karz et al. | 399/329 |
| 4,689,471 | A | 8/1987 | Pirwitz et al. | |
| 4,860,047 | A | 8/1989 | Pirwitz | |
| 4,933,724 | A | 6/1990 | Sugimoto et al. | |
| 5,046,146 | A | 9/1991 | Bartman et al. | |
| 5,053,829 | A | 10/1991 | Field et al. | |
| 5,212,529 | A | 5/1993 | Morris et al. | |
| 5,268,559 | A | 12/1993 | Jacobs | |
| 5,349,424 | A | 9/1994 | Dalal et al. | |
| 5,359,401 | A | 10/1994 | Uehara et al. | |
| 5,467,178 | A | 11/1995 | Mui et al. | |
| 5,614,999 | A | 3/1997 | Kanesawa et al. | |
| 5,621,512 | A | 4/1997 | Uehara et al. | |
| 5,641,568 | A | 6/1997 | Satoh et al. | |
| 5,666,624 | A | 9/1997 | Kanesawa et al. | |
| 5,832,353 | A | 11/1998 | Sano | |
| 5,866,875 | A | 2/1999 | Okabayashi | |

(Continued)

FOREIGN PATENT DOCUMENTS

| | | |
|---|---|---|
| JP | 60-151677 | 8/1985 |

(Continued)

*Primary Examiner*—Quana Grainger
(74) *Attorney, Agent, or Firm*—Stevens & Showalter LLP

(57) ABSTRACT

Fusing systems are provided that utilize a heated fusing roller in conjunction with a backup belt assembly to provide a large fusing region within a minimal amount of space. The heated fusing roller comprises a thin walled steel roll having an elastomeric inner layer and a non-resilient flouropolymer release layer. The thin wall steel core allows for relatively faster warm up times compared to conventional fusing systems. Moreover, the backup belt assembly allows for the varying of the pressure profile and the enhancement of media release. The utilization of this design minimizes the size of the system necessary to attain the adhesion of toner to the media, which in turn reduces the cost of the mechanism. Further, the use of the varying pressure nip minimizes the amount of friction between a belt support member and the belt itself, which may reduce friction, wear, and will reduce the risk of print quality defects. Overall, the various embodiments of the present invention contain functional flexibility, a relatively small functional envelope, and better performance at a lower cost compared to conventional fusing systems.

34 Claims, 7 Drawing Sheets

U.S. PATENT DOCUMENTS

| | | | |
|---|---|---|---|
| 5,887,235 | A | 3/1999 | Wayman et al. |
| 5,890,032 | A | 3/1999 | Aslam et al. |
| 5,890,043 | A | 3/1999 | Uehara |
| 5,890,047 | A | 3/1999 | Moser |
| 5,960,243 | A | 9/1999 | Daigo et al. |
| 5,999,788 | A | 12/1999 | Kanesawa et al. |
| 6,118,969 | A | 9/2000 | Curry et al. |
| 6,173,152 | B1 | 1/2001 | Schlueter, Jr. et al. |
| 6,198,888 | B1 | 3/2001 | Kurotaka et al. |
| 6,201,938 | B1 | 3/2001 | Hollar et al. |
| 6,253,046 | B1 | 6/2001 | Horrall et al. |
| 6,321,061 | B1 | 11/2001 | Sonobe et al. |
| 6,327,455 | B1 | 12/2001 | Hamilton et al. |
| 6,333,490 | B1 | 12/2001 | Higashi et al. |
| 6,336,009 | B1 | 1/2002 | Suzumi et al. |
| 6,347,201 | B1 | 2/2002 | Sano et al. |
| 6,423,941 | B1 | 7/2002 | Kanari et al. |
| 6,442,365 | B1 | 8/2002 | Schlueter, Jr. et al. |
| 6,490,429 | B1 | 12/2002 | Okayasu et al. |
| 2002/0025200 | A1 | 2/2002 | Fujimoto et al. |
| 2002/0071700 | A1 | 6/2002 | Nishitani et al. |
| 2002/0085851 | A1 | 7/2002 | Murata et al. |
| 2002/0085866 | A1 | 7/2002 | Okayasu et al. |
| 2002/0090237 | A1 | 7/2002 | Tanaka et al. |
| 2002/0127022 | A1 | 9/2002 | Tanaka |

FOREIGN PATENT DOCUMENTS

| | | | |
|---|---|---|---|
| JP | 60-151681 | | 8/1985 |
| JP | 62-014675 | | 1/1987 |
| JP | 05018449 A | * | 1/1993 |
| JP | 05-150679 | | 6/1993 |

* cited by examiner

BACKUP BELT ASSEMBLY FOR USE IN A FUSING SYSTEM AND FUSING SYSTEMS THEREWITH

BACKGROUND OF THE INVENTION

The present invention relates to an electrophotographic imaging apparatus, and more particularly to a backup belt assembly for use in a fusing system of such an apparatus.

In electrophotography, a latent image is created on the surface of an electrostatically charged photoconductive drum by selectively exposing the drum surface to light. Essentially, light alters the electrostatic density of the surface of the drum in the areas exposed to the light relative to those areas unexposed to the light. The latent electrostatic image thus created is developed into a visible image by exposing the electrostatic charge on the surface of the drum to toner, which contains pigment components and thermoplastic components. When so exposed, the toner is attracted to the drum surface corresponding to the electrostatic density altered by the light. A transfer medium such as paper is given an electrostatic charge opposite that of the toner and is passed close to the drum surface. As the medium passes the drum, the toner from the drum surface is pulled onto the surface of the medium in a pattern corresponding to the pattern of the toner on the drum surface. The medium then passes through a fuser that applies heat and pressure thereto. The fuser heat causes constituents including the thermoplastic components of the toner to flow into the interstices between the fibers of the medium and the fuser pressure promotes settling of the toner constituents in these voids. As the toner is cooled, it solidifies and adheres the image to the medium.

Over time, a variety of fusing system designs have been suggested, including radiant fusing, convection fusing, and contact fusing. However, contact fusing is the typical approach of choice for a variety of reasons including cost, speed and reliability. Contact fusing systems themselves can be implemented in a variety of manners. For example, a roll fusing system consists of a fuser roll and a backup roll in contact with one another so as to form a nip point therebetween, which is under a specified pressure. A heat source is applied to the fuser roll, backup roll, or both rolls in order to raise the temperature of the rolls to a temperature capable of adhering unfixed toner to a medium. As the medium passes through the nip point, the toner is adhered to the medium via the pressure between the rolls and the heat resident in the fusing region (nip point). Although roll fusing systems can provide high pressures and are generally reliable, such systems are not without significant limitations. As speed requirements demanded from the fusing system are increased, the size of the fuser and backup rolls must be increased, and the capability of the heat source must be expanded to sustain a sufficient level of energy necessary to adhere the toner to the medium in compensation for the shorter amount of time that the medium is in the nip point. This in turn can lead to long warm up times, higher cost, and unacceptably large rolls.

As an alternative to the roll fusing system, a belt fusing system can be used. The traditional belt fusing system consists of a single fuser roll that is pressed into contact with a belt to define a fusing region. A heat source is then applied to the fuser roll, belt or both to generate sufficient heat within the system to adhere unfixed toner to a medium as the medium is passed between the fuser roll and the belt. Generally, a belt fusing system has a quicker warm up time and a lower cost with respect to a comparable roll fusing system. However, the typical belt system requires that the pressure in the nip region be relatively low to prevent the belt from stalling during the fusing process. Thus the belt fusing system can prohibit the use of high pressure nip profiles that aid the release of the medium from the nip area. Also, typical belt fusing systems require more heat than comparable roll fusing system, which may potentially cause wear issues associated with the interface between the belt and a support member required to hold the belt.

SUMMARY OF THE INVENTION

The present invention overcomes the disadvantages of the prior art by providing fusing systems that utilize a fusing roller in conjunction with a backup belt assembly to provide a large fusing region within a minimal amount of space.

According to an embodiment of the present invention, a backup belt assembly for a fusing system comprises a belt support member having at least one belt tracking surface; one or more nip forming rollers supported by the belt support member so as to be rotatable with respect thereto, and a backup belt disposed about the belt support member. Rotation of the backup belt, e.g. as a result of frictional contact with a rotating fusing member, causes a corresponding rotation of the nip forming roller(s) and further causes the backup belt to slide about the backup belt support member with respect to the belt tracking surface(s).

During fusing operations, the nip forming roller(s) of the backup belt assembly press the backup belt against a fuser roll defining a fusing region at the nip therebetween. Utilization of the backup belt assembly of the present invention allows reduction in the size of the fusing system necessary to attain the adhesion of toner to media, which in turn reduces the cost of the fusing system. Also, the backup belt assembly allows for varying the pressure profile of the fusing region. The fusing region can be made variable through the selection of the quantity of nip forming rollers, and/or by selection of the size and compliance of each of the nip forming roller(s). The variable pressure nip minimizes the amount of friction between the belt support member and the belt itself, which may reduce wear and reduce the risk of print quality defects. The variable pressure nip also allows for increased nip pressure where the media exits the fusing region, which enhances media release.

According to another embodiment of the present invention, a system for fusing an unfixed toner image to a media comprises a rotatable fusing member and a backup belt assembly positioned with respect to the fusing member so as to define a fusing region at a nip therebetween. The backup belt assembly includes a belt support member having at least one belt tracking surface, a first nip forming roller supported by the belt support member so as to be rotatable with respect thereto, and a backup belt disposed about the belt support member. Rotation of the backup belt causes corresponding rotation of the first nip forming roller and further causes the backup belt to slide about the belt support member with respect to the belt tracking surface(s).

According to yet another embodiment of the present invention, a fusing system comprises a rotatable fusing member, a backup belt assembly and a release mechanism. The release mechanism is arranged to selectively reposition the backup belt assembly between a first position wherein the backup belt is urged against the fusing member so as to define the fusing region at the nip therebetween, and a second position wherein the backup belt assembly is released from the rotatable fusing member. The belt assembly includes a belt support member having first and second belt tracking surfaces. First and second nip forming rollers are supported by the belt support member so as to be rotatable with respect thereto. However, the first and second nip forming rollers are not independently repositionable with respect to the belt support member during fusing operations. That is, there is no spring bias or tensioning device that allows independent, non-rotational movement of the first and second nip forming rollers with respect to the belt support member during fusing operations. A backup belt is disposed about the belt support member such that rotation of the backup belt causes corresponding rotation of the first and second nip forming rollers and further causes the backup belt to slide with respect to the first and second belt tracking surfaces.

Overall, the various embodiments of the present invention provide functional flexibility, a relatively small functional envelope, and better performance at a lower cost compared to conventional fusing systems.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
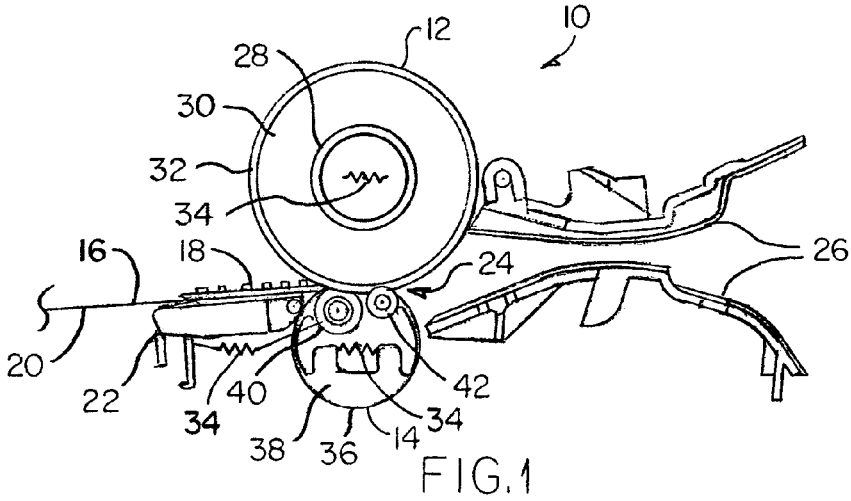
FIG. 1 is a side view schematically illustrating a fusing system according to an embodiment of the present invention.

Referring to FIG. 1, a fusing system 10 according to an embodiment of the present invention is illustrated. The fusing system 10 includes generally, a fusing member 12 and a backup belt assembly 14. A media 16 bearing unfixed toner 18 on a surface thereof is delivered to the fusing system 10 on a media transport 20 and an associated media guide 22. The media 16 is passed into a fusing region 24 defined generally by the area between the fusing member 12 and the backup belt assembly 14, and exits the fusing region 24 in cooperation with media exit guides 26. The fusing system 10 applies a combination of heat and pressure to the media 16 while in the fusing region 24 to facilitate fusing of the toner 18 to the media 16. Further, the shape of the fusing region 24 at the media exit provides a shearing force that allows the media 16 to cleanly release from the fusing system 10. Notably, the fusing member 12 and backup belt assembly 14 are configured such that the media 16 is traveling at a faster velocity on the top side thereof when the media 16 exits the fusing region 24. This velocity mismatch causes the media 16 to follow its bottom surface, which increases the reliability of media release.

The fusing member 12 is implemented as a fuser roll as shown in FIG. 1, but other structures can be substituted therefore. According to an embodiment of the present invention, the fuser roll comprises a hollow, generally tubular core 28 covered by a compressible layer 30, which is in turn, covered by a flouropolymer release layer 32. The fusing member 12 may further include a heating element 34 positioned within the core 28. The thermal mass of the fusing member 12 serves as a limiting factor to warm up times. Accordingly, the core 28 is preferably a strong material with relatively low mass and high thermal conductivity. The dimensions of the core 28 and the manufacturing tolerances associated therewith should be specified such that the core 28 exhibits sufficient strength to withstand manufacturing into a roll and to be suitable for the intended fusing application. For example, according to an embodiment of the present invention, the core 28 comprises a steel or a steel alloy tube having a nominal wall thickness of 0.5 millimeters. The use of the relatively thin walled steel core 28 allows for significant decreases in warm up time in comparison to the aluminum cores used in the art, which typically specify a 2.0 millimeter nominal wall thickness. According to an embodiment of the present invention, the use of the 0.5 millimeter steel core in combination with the backup belt assembly 14 disclosed in greater detail herein has allowed warm up times to be reduced to approximately one-third of the warm up time typical of fusing systems for comparable applications.

The compressible layer 30 possesses the required properties necessary to perform applications typically associated with fusing operations. For example, the compressible layer 30 may comprise an elastomer such as silicone rubber, which may include processing, stabilizing, strengthening and curing additives. The flouropolymer release layer 32 is a non-resilient layer that provides a surface that will not stick to the unfixed toner 18 or media 16 during the fusing process. The compressible layer 30 and flouropolymer release layer 32 are secured to the core 28 in an appropriate manner so as to rotate as an integral unit therewith. For example, according to an embodiment of the present invention, a 0.5 millimeter nominal thickness steel core 28 is set into a mold. A flouropolymer release layer 32, in the form of a sleeve, is inserted over the core 28, and an elastomer is injected between the core 28 and the flouropolymer release layer 32. The assembly is then baked for a suitable duration to achieve characteristics suitable for the fuser roll.

A heating element 34, e.g. a resistor or lamp such as a halogen light, may be installed within the hollow portion of the core 28 to provide energy to the fusing system 10 for adhering the toner 18 to the media 16. Heat in the range of about 140 degrees to about 200 degrees Celsius is typically used, however other temperatures may be necessary depending upon the particular fusing requirements. Also, other arrangements can be provided in addition to, or in lieu of the use of a heating element 34 in the core 28. For example, heat may be applied to the outside of the fusing member 12 and/or to the backup belt assembly 14.

The backup belt assembly 14 includes generally, a continuous backup belt 36, a belt support member 38 and one or more nip forming rollers. There are two nip forming rollers 40, 42 as shown, which are supported by the belt support member so as to be rotatable with respect thereto. The backup belt 36 is disposed about the belt support member 38 and nip forming rollers 40, 42. Moreover, the nip forming rollers 40, 42 press the backup belt 36 against the fusing member 12 thus defining the fusing region 24.

According to an embodiment of the present invention, the backup belt 36 comprises polyimide formed into a continuous loop having a nominal thickness in the range of 25–150 microns, and more preferably a nominal thickness of about 80 microns. Other belt materials and thicknesses may also be used however. The thermal characteristics of the backup belt 36 allow it to be heated almost instantaneously to approximately the temperature of the surface of the fusing member 12 within the fusing region 24. The heat transferred to the backup belt 36 from the fusing member 12 stays on the backup belt surface (at least until the media 16 passes through the fusing region 24), thus effecting warm up time. As such, a separate heating element may not be required in the backup belt assembly 14. However, a second heat source applied internally or externally to the backup belt 36 may be used where temperature stability becomes an issue. The use of an additional heat element 34 may require the use of a thermally conductive belt 36 for heating internal to the backup belt assembly 14, or a thermally insulating belt for external heating with respect to the backup belt assembly 14.

During fusing operations, rotation of the fusing member 12 causes a corresponding rotation of the backup belt 36. Rotation of the backup belt 36 causes in turn, a corresponding rotation of the nip forming rollers 40, 42. However, the belt support member 38 itself does not rotate. Rather, each nip forming roller 40, 42 rotates within the belt support member 38, and the backup belt 36 rotates about the belt support member 38. The nip forming rollers 40, 42 thus serve to reduce the losses due to frictional engagement of backup belt 36 against the support member 38, and as will be described in greater detail herein, serve to increase the realizable fusing region 24. The nip forming rollers 40, 42 also reduce the need for friction reducing material between the backup belt 36 and the belt support member 38.

The construction of the nip forming rollers 40, 42, including the selection of the material and dimensions for each of the nip forming rollers 40, 42 will be dictated by a number of factors such as the required pressure, pressure profile, heat and/or speed of operation of a particular fusing system 10. Further, the roughness and choice of materials of the belt 36 and nip forming rollers 40, 42 can control the frictional load therebetween. A few exemplary nip forming rollers 40, 42 include a metal e.g. steel roll, a rubber coated roll and a silicone foam covered roll. Moreover, the nip forming rollers 40, 42 can exhibit the same or different dimensions as well as the same or different materials of construction.

Figure 2A:
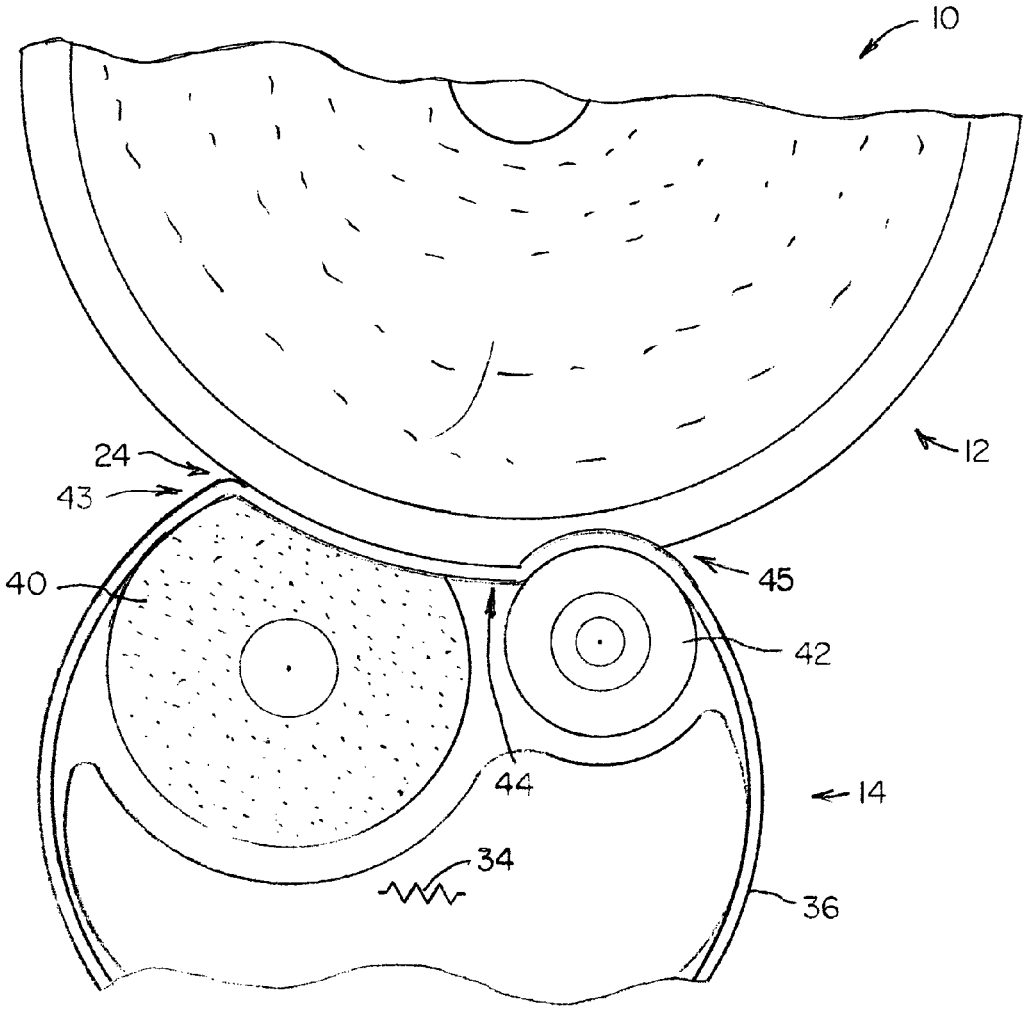
FIG. 2A is an exploded side view of a fusing member and a backup belt assembly of the fusing system shown in FIG. 1, illustrating the relationship between the fusing member and nip rollers of the backup belt assembly according to an embodiment of the present invention.

Referring to FIG. 2, the nip forming rollers 40, 42 of the backup belt assembly 14 allow the fusing region 24 between the fusing member 12 and the backup belt assembly 14 to be increased to an area suitable for the particular fusing operation to which the fusing system 10 is implemented. The backup belt 36 is pressed against the fusing member 12 from the interior side of the backup belt 36 by the first and second nip forming rollers 40, 42. As shown, the first nip forming roller 40 is a relatively large diameter, compliant roller as schematically illustrated by the deformation of the surface of the first nip forming roller 40 in the area that forces contact of the belt 36 with the fusing member 12. The second nip forming roller 42 is relatively smaller in diameter, and is less compliant than the first nip forming roller 40. As schematically illustrated, the fusing member 12 deflects in the area where the second nip forming roller 42 forces contact of the belt 36 with the fuising member 12. Notably, as the first nip forming roller 40 is compressed, the area of contact between the fusing member 12 and the backup belt 36 increases providing a greater fusing region 24. It shall be noted that the deflection of the fusing member 12 and nip forming roller 40 are exaggerated in FIG. 2 to illustrate various aspects of the present invention. In practice, the actual deflection (if deflection occurs) of the fusing member 12 and/or the nip forming rollers 40, 42 will vary depending upon the compliance of the fusing member 12, the compliance of the nip forming rollers 40, 42, and the pressure between the fusing member 12 and the backup belt assembly 14.

According to an embodiment of the present invention, the first nip forming roller 40 comprises a compliant roller that generates a low pressure area 43 in the vicinity of the media entrance to the fusing region 24. The second nip forming roller 42 comprises a less compliant roller that generates a high pressure area 45 in the vicinity of the media exit from the fusing region 24, which is necessary for media release. For example, the first nip forming roller 40 may comprise a foam or soft rubber material and the second nip forming roller 42 may comprise a rubber or metal material. Further, a transition area 44 may exist between the low pressure area 43 and the high pressure area 45. This arrangement may be beneficial because it limits the amount of the high pressure area 45 necessary for media release from the fusing region 24. This implementation may also reduce the overall friction and wear between the backup belt 36 and nip forming rollers 40, 42 while delivering a large fusing region 24 with minimal physical requirements for the roll size of the fusing member 12. Moreover, this implementation may reduce the risk of belt stalls and potential print defects because the high pressure area of the fusing region 24 is limited.

The amount of pressure applied to the media in the fusing region 24 varies as it passes therethrough. The varying pressure is due at least in part, to the difference in compliance of the nip forming rollers 40, 42 and the spacing therebetween. As such, the nip forming rollers 40, 42 may be selected from appropriate materials and positioned with respect to each other when installed in the belt support member so as to achieve a desired pressure profile. That is, the size of the fusing region 24, and the amount of pressure applied along the length of the fusing region 24 can be controlled by the selection of the size, positioning and compliance of each of the nip forming rollers 40, 42. For example, to minimize significant drops in pressure generally in the transition area 44, the nip forming rollers 40, 42 can be brought closer together. Also, the nip forming rollers 40, 42 may be positioned such that the high pressure area 45 proximate to the nip exit causes the media 16 to be traveling at an angle to prevent the media 16 from following the backup belt 36 or fusing member 12 subsequent to passing through the fusing region 24. Moreover, while shown with two nip forming rollers 40, 42, the present invention should not be construed as being so limited. For example, it is contemplated that one or more nip forming rollers may be used with the backup belt assembly 14.

Figure 2B:
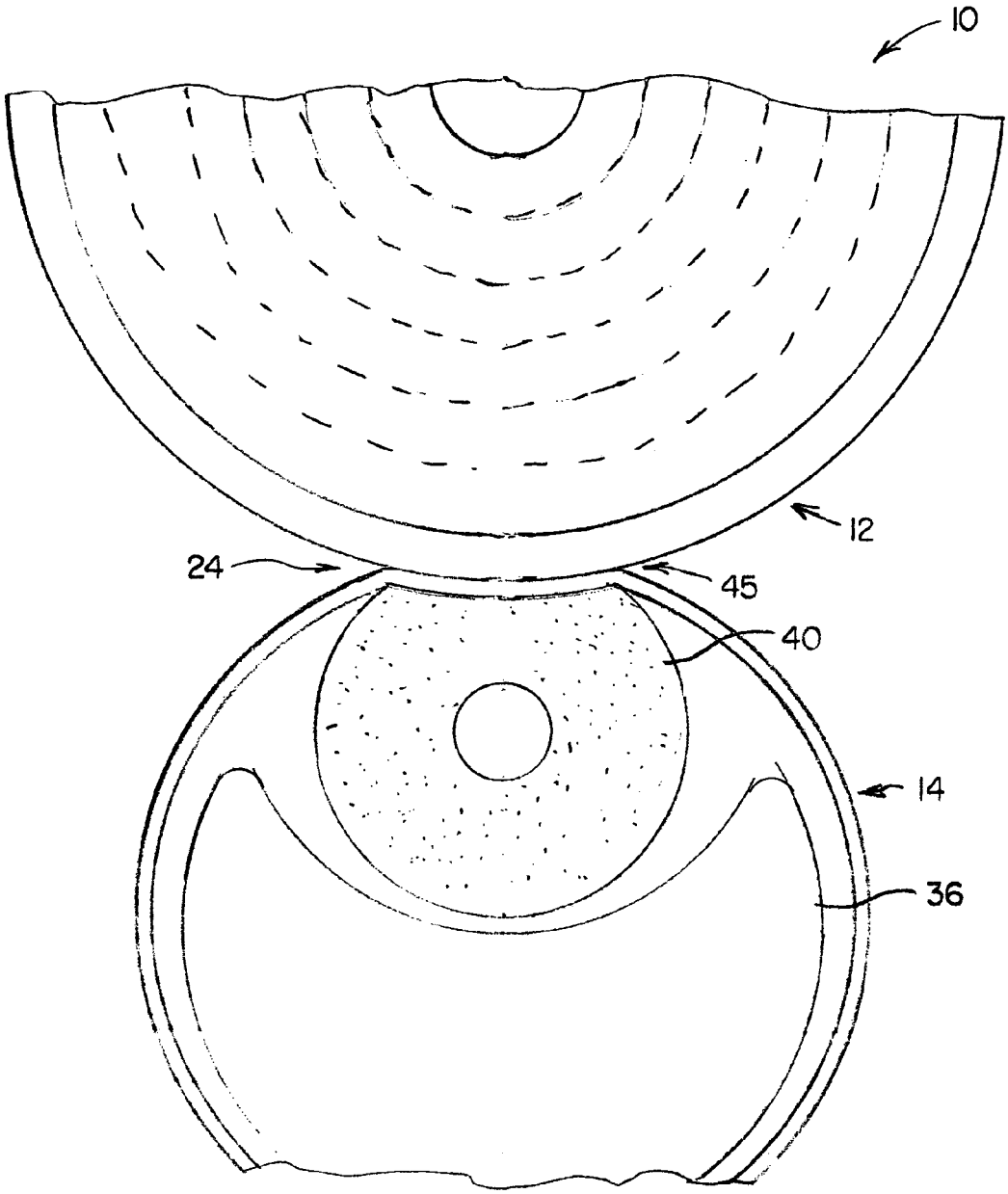
FIG. 2B is an exploded side view of a fusing member and a backup belt assembly according to another embodiment of the present invention, where the backup belt includes a single nip forming roller.

Referring briefly to FIG. 2B, there is shown an embodiment of the present invention where a single nip forming roller 40 is included in the backup belt assembly 14. As illustrated, the nip forming roller 40 is positioned in the high pressure area 45 proximate to the media exit of the fusing region 24. However, the same principles described herein with reference to the remainder of the Figures apply generally to the embodiment of FIG. 2B. For example, the size, positioning and compliance of the roller 40 can be selected to define a variable pressure fusing region 24. Moreover, the roughness and choice of materials of the backup belt 36 and the nip forming roller 40 can be selected to control the frictional load therebetween.

Figure 3:
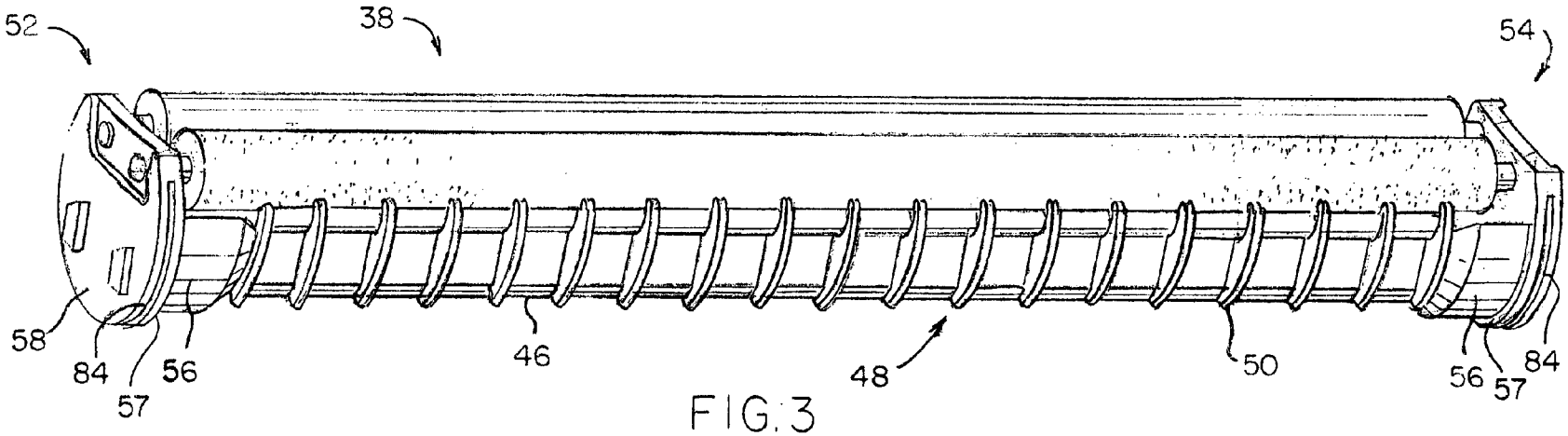
FIG. 3 is a projection view of a backup belt assembly according to an embodiment of the present invention with the backup belt removed to illustrate the belt support member.

Referring to FIG. 3, the belt support member 38 is illustrated with the backup belt 36 removed. The belt support member 38 includes an elongate body 46 that is generally trough shaped having a curved lower portion 48, a series of ribs or projections 50 that extend radially out from the lower portion 48, first and second axial end portions 52, 54 and at least one belt tracking surface 56, 57 for supporting the backup belt 36. For example, as shown, each axial end portion 52, 54 includes belt tracking surfaces 56, 57. The belt tracking surfaces 56, 57 provide the area upon which the backup belt 36 contacts the belt support member 38. Accordingly, rotation of the backup belt causes the backup belt 36 to slide about the belt support member with respect to the tracking surface(s) 56, 57. Notably, not all of the belt tracking surfaces 56, 57 need to contact the belt at any given time during fusing operations. For example, belt tracking surfaces 57 limit the distances that the backup belt 36 can "walk" from side to side of the belt support member 38. The belt tracking surfaces 56, 57 also ensure that minimal contact is made between the belt support member 38 and the backup belt 36 thus minimizing the contact and thus the friction therebetween. This may prevent the belt support member 38 from unduly drawing heat from the backup belt 36.

According to an embodiment of the present invention, the nip forming rollers 40, 42 are supported by the belt support member 38 so as to be rotatable with respect thereto. However, the nip forming rollers 40, 42 are prevented from being independently repositionable with respect to the belt support member 38 during fusing operations. That is, there is no independent tension or biasing adjustments that allow non-rotational movement of the nip forming rollers 40, 42 (e.g. no radial movement of a shaft of the nip forming roller 40, 42 towards or away from the fusing member 12) with respect to the belt support member 38 during fusing operations. Rather, the belt support member 38 and nip forming rollers 40, 42 move as an integral unit.

The nip forming rollers 40, 42 are positioned such that at least a portion of the surfaces of the rollers 40, 42 extend above the belt support member 38. Accordingly, when the backup belt 36 is installed over the belt support member 38 and the backup belt assembly 14 is engaged with the fusing member 12, the backup belt 36 contacts the fusing member 12 on an outside surface thereof, and the backup belt 36 contacts each of the nip forming rollers 40, 42 and the tracking surfaces 56, 57 of the belt support member 38 on an inner surface thereof.

Figure 4:
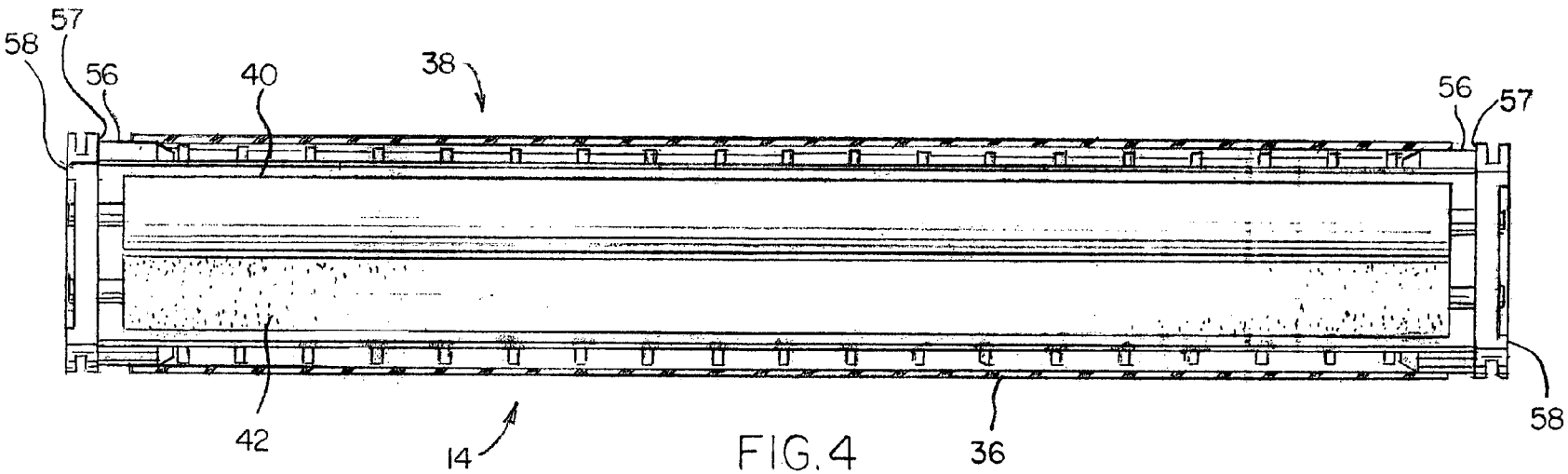
FIG. 4 is a top view of the backup belt assembly of FIG. 3 where the backup belt is shown cut away to illustrate the relationship between the nip rollers and the belt support member.

Referring to FIG. 4, a top view of the backup belt assembly 14 is shown with the backup belt 36 cut away to illustrate the relationship between the backup belt 36, belt support member 38 and nip forming rollers 40, 42 according to an embodiment of the present invention. Under normal conditions, the backup belt 36 avoids contact with the belt support member 38 except for the tracking surfaces 56, 57, which support the inside surface of the backup belt 36. During fusing operations, it is possible for the backup belt 36 to deflect, and as such, the backup belt 36 may momentarily contact one or more of the ribs 50. The ribs 50 define a relatively small surface however, which serves to minimize friction and heat loss due to transfer of heat from the backup belt 36 to the belt support member 38 via contact.

Optionally, end caps 58 may be provided about the respective axial ends of the belt support member 38. The end caps 58 may provide an efficient means during assembly and manufacture thereof, to ensure that the nip forming rollers 40, 42 are fixedly secured to the belt support member 38. The end caps 58 may further provide the tracking surfaces 56, 57 as an alternative to the tracking surfaces 56, 57 being provided integral with the remainder of the belt support member 38.

Figure 5:
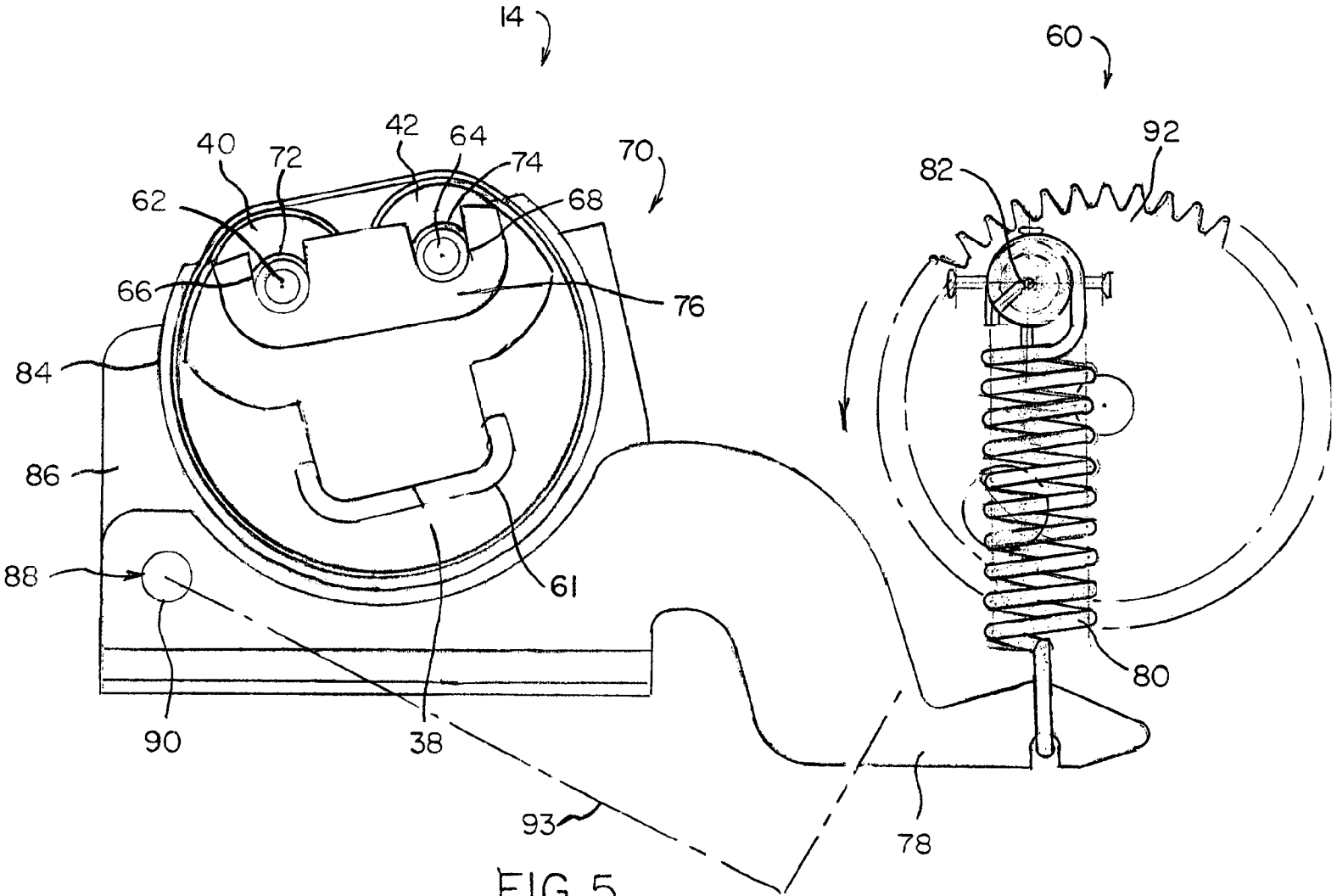
FIG. 5 is a side view of an assembly including the backup belt assembly of FIG. 3 with an end cap removed to illustrate detail of the belt support member, and a portion of a fusing nip release mechanism used to reposition the backup belt assembly.

Referring to FIG. 5, a side view of the backup belt assembly 14 is illustrated with the end caps 58 cut away to illustrate the positioning of the nip forming rollers 40, 42 within the belt support member 38 according to an embodiment of the present invention. FIG. 5 also illustrates a partial view of an exemplary fusing nip release mechanism 60 used to selectively reposition the backup belt assembly 14 with respect to the fusing member 12. It is possible that deflection of the belt support member 38 may occur during fusing operations. As such, an optional bracket 61, such as a metal member, may be used to load the belt support member 38 against the fusing member 12. Essentially, the bracket 61 provides structural support to the backup belt assembly 14 and resists deflection thereof.

The nip forming rollers 40, 42 can be mounted with respect to the belt support member 38 in any suitable manner. For example, according to an embodiment of the present invention, a nip roller support member 76 is positioned at each respective end portion 70 of the belt support member 38. The nip roller support member 76 includes slots 66, 68 therein. As shown, shaft 62 is seated in slot 66 and shaft 64 is seated in slot 68. Each slot 66, 68 may also optionally support an associated bearing 72, 74 therein, such as by press fitting the bearing 72, 74 into the corresponding slot 66, 68.

Figure 6:
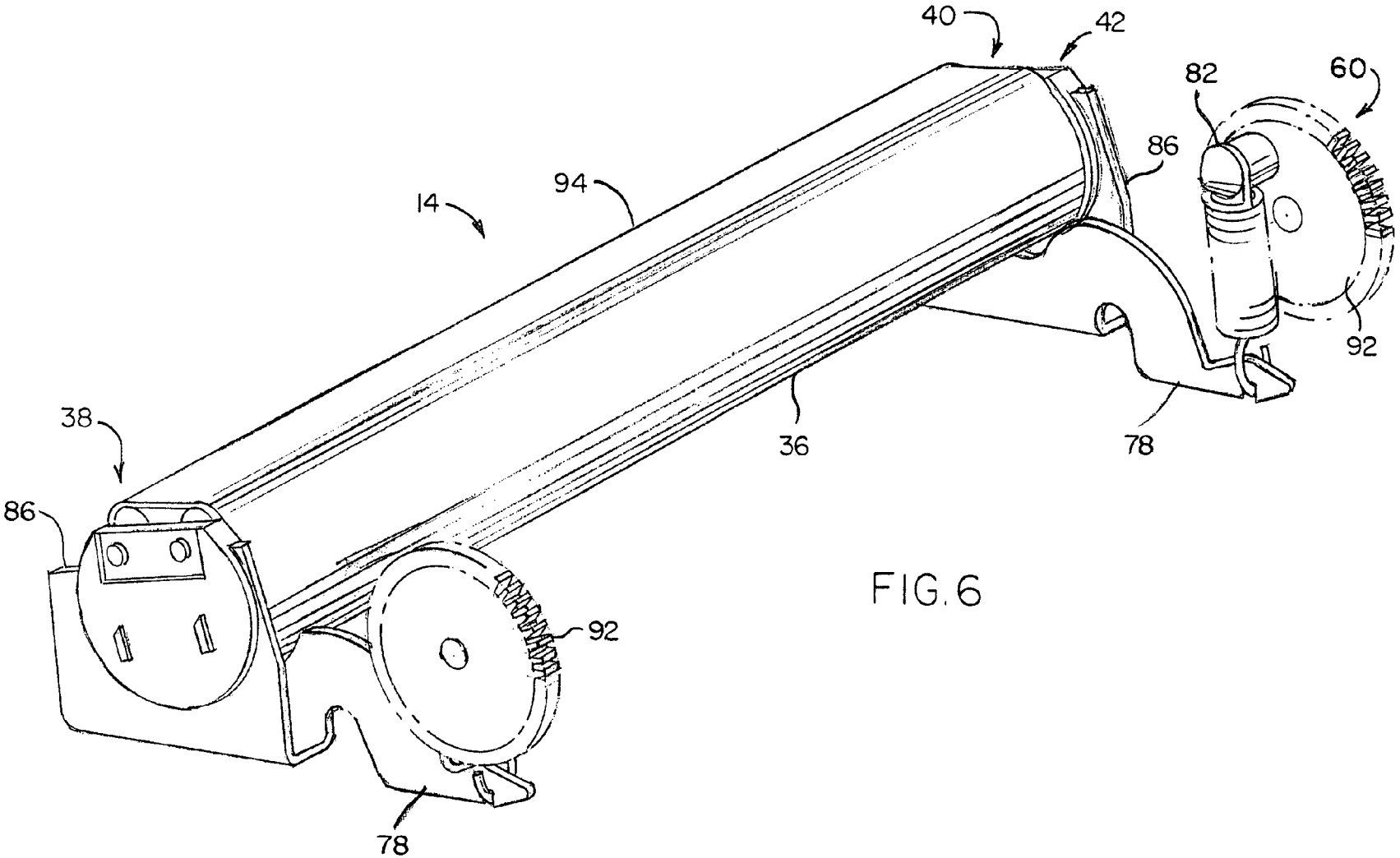
FIG. 6 is a projection view of an assembly including a backup belt assembly and a portion of a fusing nip release mechanism according to an embodiment of the present invention.
Figure 8A:
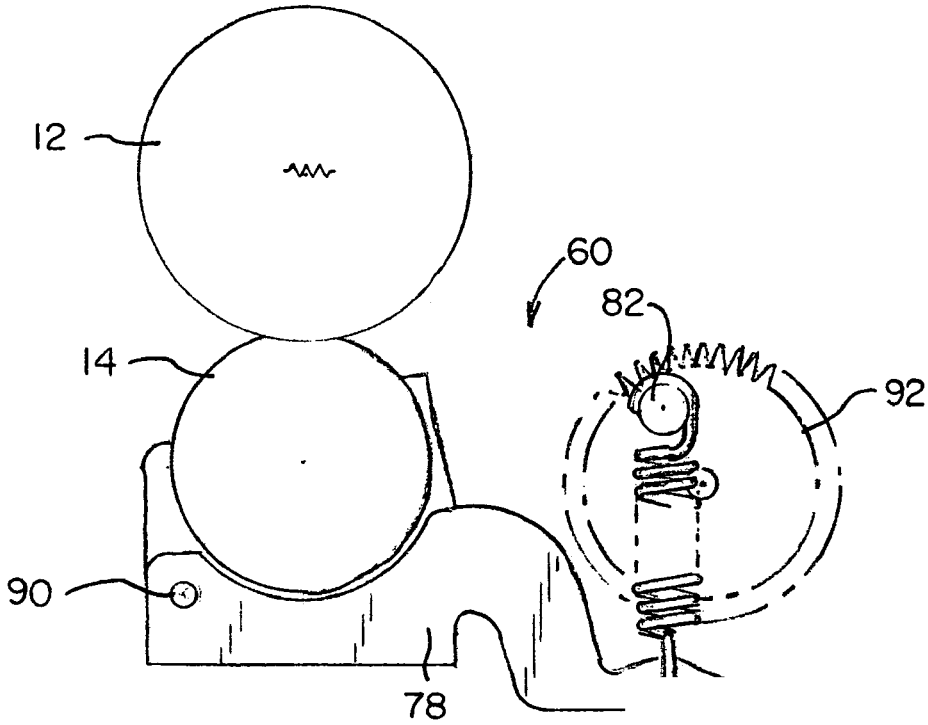
FIG. 8A is a schematic illustration of the backup belt assembly rotated to a first position wherein the backup belt is urged against a fusing member according to an embodiment of the present invention.
Figure 8B:
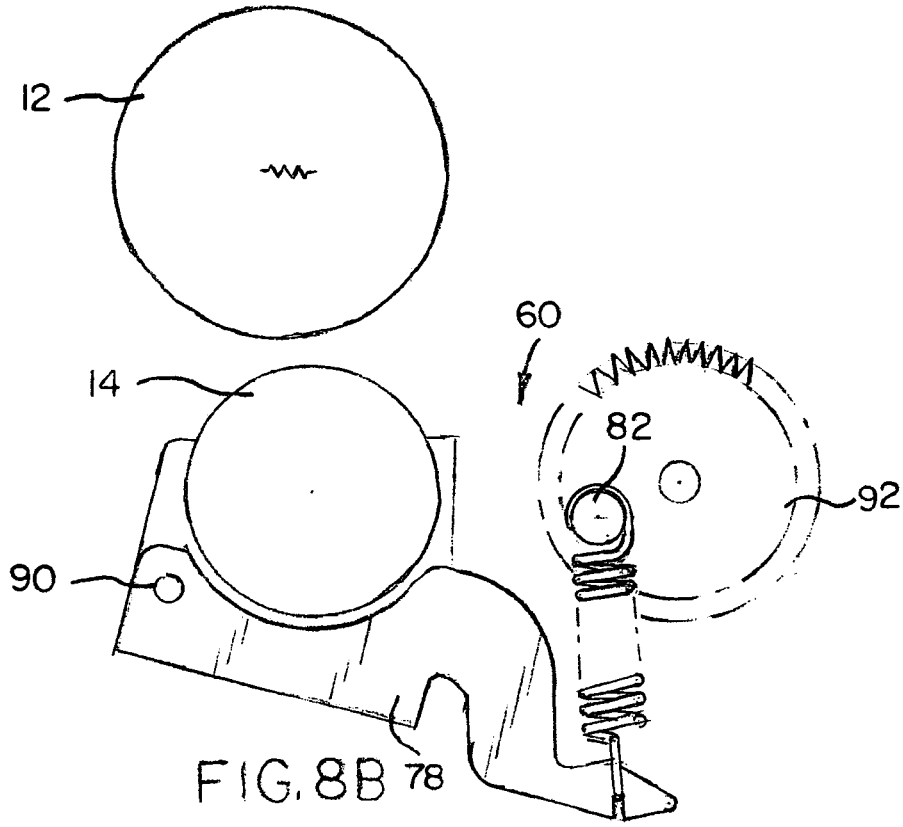
FIG. 8B is a schematic illustration of the backup belt assembly rotated to a second position wherein the backup belt is released from engagement with the fusing member according to an embodiment of the present invention.

The exemplary fusing nip release mechanism 60 can be used to bias the backup belt assembly 14 against an associated fusing member 12. Essentially, a bellcrank 78 is secured to the belt support member 38 on each axial end portion 70 thereof. Each bellcrank 78 is also coupled via a biasing member 80, e.g. a spring, to a pin 82, which is secured to a gear. For example, as shown, the belt support member 38 includes a slot 84 (best seen in FIG. 3) around the periphery of each axial end portion thereof. Each bellcrank 78 includes a corresponding slot receiving support 86 that engages the slot 84 in the belt support member 38 for securement thereto (as best seen in FIG. 6). Each bellcrank 78 is further pivotable about a rod 90 that extends between the bellcranks 78 along an axis 88. The gears 92 can be driven by a suitable driving device (not shown) to transition the pin 82 so as to rotate the bellcranks 78 about axis 88. This in turn, pivots the belt support member 38 about axis 88. For example, the gears 92 may be driven so as to rotate the pins 82, and hence the backup belt assembly 14 to a first position as shown in FIG. 5. In the first position, the backup belt assembly 14 is urged against the fusing member (as best seen in FIG. 8A). The gears 92 may also be driven so as to lower the pins 82, which in turn, pivots that backup belt assembly 14 about axis 88 as indicated by the pivot indicator 93, to a second position released from the fusing member 12 (as best seen in FIG. 8B).

Referring to FIG. 6, the backup belt assembly 14 is illustrated along with a partial view of the exemplary fusing nip release mechanism 60 illustrating the backup belt 36 installed on the belt support member 38. Notably, the positioning of the nip forming rollers 40, 42 causes the backup belt 36 to flatten out about the top portion 94 of the backup belt assembly 14. As pointed out above, this arrangement allows a greater fusing surface when the backup belt 36 engages the fusing member 12.

Figure 7:
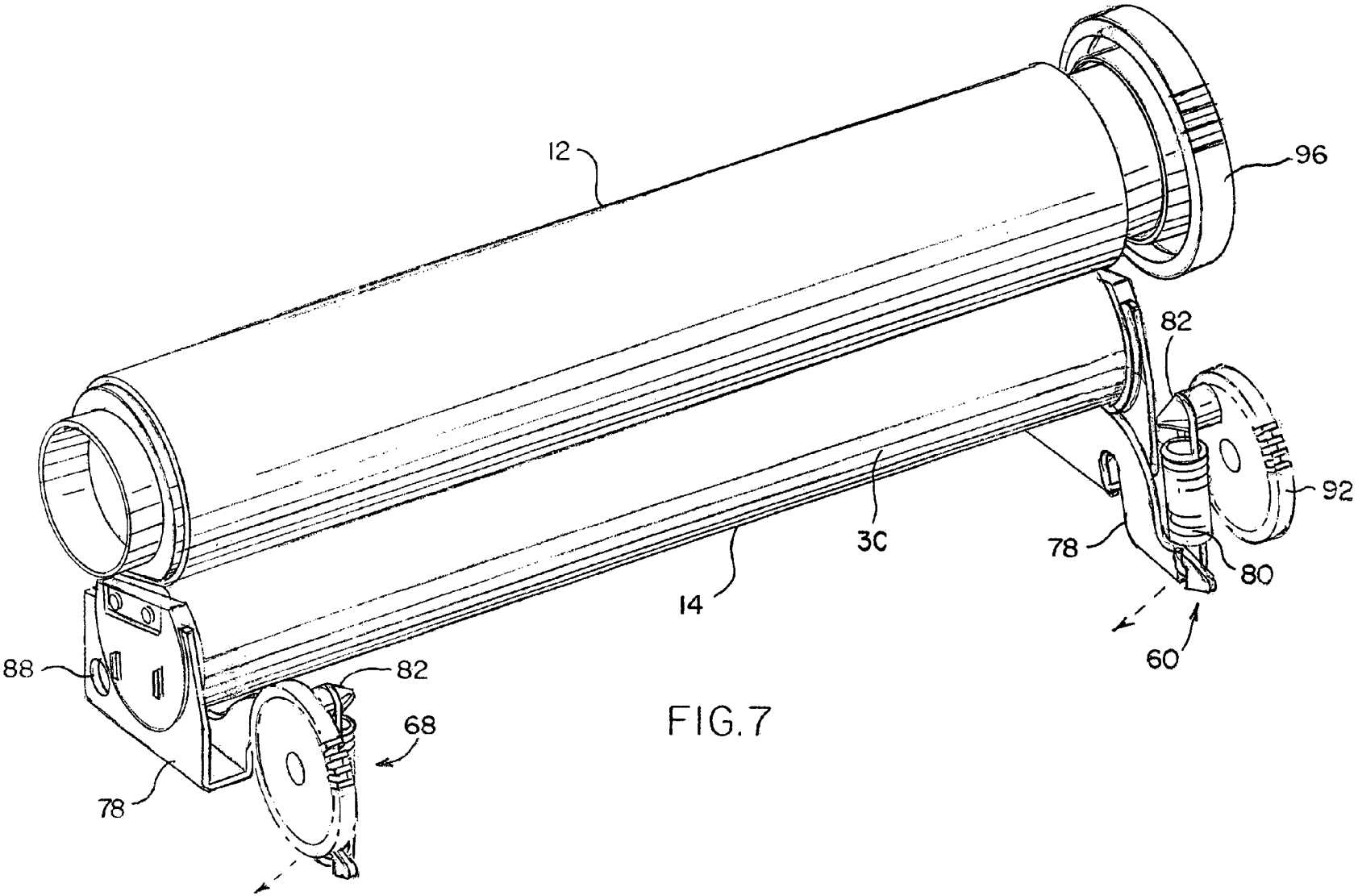
FIG. 7 is a projection view of an assembly illustrating a backup belt assembly, a fuser roll and a portion of an exemplary fusing nip release mechanism for urging the backup belt assembly against the fuser roll.

Referring to FIG. 7, the backup belt assembly 14 is illustrated with respect to the fusing member 12 according to an embodiment of the present invention. When the gears 92 of the nip release mechanism 60 are rotated so as to transition the pins 82 to an upper position, the bellcranks 78 rotate about the pivot axis 88 in response to a pulling action from the springs 80, and the backup belt assembly 14 is rotated up into a first position in which the backup belt 36 engages the fusing member 12 (see also FIG. 8A). In the first position, rotation of the fusing member 12, such as by coupling a driving device (not shown) to a gear 96, causes rotation of the backup belt assembly 14 via frictional engagement therebetween. Rotation of the gears 92 such that the pins 82 are lowered cause the bellcranks 78 to pivot downward about the pivot axis 88 and thus the backup belt assembly is rotated back out of position with respect to the fusing member 12 as illustrated in FIG. 8B. According to an embodiment of the present invention, the backup belt 14 is maintained in the second position released from the fusing member 12 during idle times of a corresponding electrophotographic device. For example, the release mechanism 60 may be operatively configured to transition the backup belt assembly 14 from the second position to the first position during fusing operations, and return the backup belt assembly 14 to the second position subsequent to the completion of the initiated fusing operations. The system may alternatively maintain the backup belt assembly 14 in the first position until a specified event occurs. For example, a "power saver" mode of operation may trigger the operation of the release mechanism 60 to transition the backup belt assembly 14 to the second position. Also, the release mechanism 60 may move the backup belt fusing assembly 14 to the second position upon the detection of an occurrence such as a media jam.

The springs 80 further serve to provide a bias to the entire backup belt assembly 14. The spring action between the pin 82 and the bellcranks 78 allows a little give to reduce the likelihood of binding. Alternative fusing nip release mechanisms can be used with the various backup belt assembly 14 arrangements of the present invention including for example, those mechanisms disclosed in U.S. Pat. No. 6,253,046 to the same assignee, the contents of which are incorporated by reference herein in its entirety.

With reference to FIGS. 1–7 generally, it can be seen that the media 16 is heated for a time period corresponding to the carry speed of the media transport 20 and the length of the fusing region 24. The various embodiments of the present invention provide a variable pressure member that further allows for an increase in the area of the fusing region 24 thus ensuring an adequate fixing time to fuse the unfixed toner 18 to the media 16. The combination of multiple nip forming rollers 40, 42 provides functional flexibility as the dimensions and stiffness of each nip forming roller can be selected to achieve a desired pressure profile. Moreover, the integration of multiple nip forming rollers 40, 42 into a belt fuser system allows for a relatively small functional envelope, provides better performance and lower cost compared to typical fuser systems. Also, each of the nip forming rollers 40, 42 within the backup belt assembly 14 are secured to the belt support member 38, and the entire backup belt assembly 14 is urged against the fuser roll. Accordingly, problems associated with unbalanced pressures are avoided because the nip forming rollers 40, 42 are prevented from skewing with respect to one another and moreover, the force that urges the backup belt assembly 14 against the fuser roll is constant for the entire backup belt assembly 14.

Having described the invention in detail and by reference to preferred embodiments thereof, it will be apparent that modifications and variations are possible without departing from the scope of the invention defined in the appended claims.

What is claimed is:

1. A backup belt assembly for a fusing system comprising:

a belt support member having at least one belt tracking surface;

a first nip forming roller supported by said belt support member so as to be rotatable with respect thereto; and a backup belt disposed about said belt support member such that rotation of said backup belt, effected by contact between a moving surface of a member in the fusing system and a surface of the backup belt, causes a corresponding rotation of said first nip forming roller and further causes said backup belt to slide about said belt support member with respect to said at least one belt tracking surface.

2. The backup belt assembly according to claim 1, further comprising a second nip forming roller supported by said belt support member so as to be rotatable with respect thereto, said first and second nip forming rollers positioned with respect to each other so as to define a predetermined pressure profile when said backup belt assembly is urged against a fusing member.

3. The backup belt assembly according to claim 2, wherein said first nip forming roller has a larger nominal diameter than said second nip forming roller.

4. The backup belt assembly according to claim 2, wherein said first nip forming roller is more compliant than said second nip forming roller.

5. The backup belt assembly according to claim 2, wherein said first nip forming roller has a larger nominal diameter than said second nip forming roller, and said first nip forming roller is more compliant than said second nip forming roller.

6. The backup belt assembly according to claim 2, wherein said first nip forming roller comprises foam and said second nip forming roller comprises rubber.

7. The backup belt assembly according to claim 1, wherein said belt support member further comprises:

a generally elongate body having a first and second opposing axial end portions and a curved lower portion; and a plurality of projections that extend radially from said curved lower portion of said body.

8. The backup belt assembly according to claim 7, wherein said backup belt is disposed about said belt support member such that said backup belt nominally clears said projections on said lower portion of said body.

9. The backup belt assembly according to claim 7, wherein said at least one belt tracking surface comprises a first belt tracking surface proximate to said first axial end portion of said body and a second belt tracking surface proximate to said second axial end portion of said body.

10. The backup belt assembly according to claim 7, wherein said belt support member further comprises a first nip roller support member secured to said body proximate to said first axial end portion and a second nip roller support member secured to said body proximate to said second axial end portion, wherein said first nip forming roller is rotatably mounted between said first and second nip roller support members such that said first nip forming roller is prevented from being independently repositionable with respect to said belt support member during fusing operations.

11. The backup belt assembly according to claim 10, further comprising at least one additional nip forming roller, wherein said first and second nip roller support members each comprise a plurality of slots therein, each slot for supporting an associated one of said first nip forming roller and said at least one additional nip forming roller.

12. The backup belt assembly according to claim 11, wherein each slot further comprises a bearing for supporting an associated one of said first nip forming roller and said at least one additional nip forming roller.

13. The backup belt assembly according to claim 1, wherein said belt support member further comprises at least one support member therethrough for resisting deflection of said belt support member.

14. The backup belt assembly according to claim 1, wherein said backup belt comprises a polyimide backup belt.

15. The backup belt assembly according to claim 1, wherein said backup belt has a nominal thickness between 25 and 150 microns.

16. The backup belt assembly according to claim 15, wherein said backup belt has a nominal thickness of about 80 microns.

17. The backup belt assembly according to claim 1, wherein the roughness of at least one of said belt and said first nip forming roller is predetermined to obtain a desired frictional relationship therebetween.

18. The backup belt assembly according to claim 1, further comprising a heating element provided within said belt support member, wherein said backup belt comprises a thermally conductive belt.

19. The backup belt assembly according to claim 1, wherein said backup belt is thermally insulative such that said backup belt assembly is suitable for use with an external heating element.

20. A system for fusing an unfixed toner image to a media comprising:

a rotatable fusing member; and a backup belt assembly positioned with respect to said fusing member so as to define a fusing region at a nip therebetween, wherein said backup belt assembly comprises:

a belt support member having at least one belt tracking surface;

a first nip forming roller supported by said belt support member so as to be rotatable with respect thereto; and a backup belt disposed about said belt support member such that rotation of said backup belt, effected by contact between a moving surface of the rotatable fusing member and a surface of the backup belt, causes a corresponding rotation of said first nip forming roller and further causes said backup belt to slide about said belt support member with respect to said at least one belt tracking surface.

21. The system according to claim 20, further comprising a second nip forming roller supported by said belt support member so as to be rotatable with respect thereto, wherein said first and second nip forming rollers are selected so as to achieve a predetermined pressure profile within said fusing region.

22. The system according to claim 21, wherein said first and second nip forming rollers are configured to achieve a relatively lower pressure portion of said fusing region proximate to where media enters said fusing region and a relatively higher pressure portion of said fusing region proximate to where said media exits said fusing region.

23. The system according to claim 21, wherein said second nip forming roller is spaced proximate to where said media exits said fusing region and said first nip forming roller is spaced between said second nip forming roller and where said media enters said fusing region.

24. The system according to claim 21, wherein said first nip forming roller has a larger nominal diameter than said second nip forming roller.

25. The system according to claim 21, wherein said first nip forming roller is more compliant than said second nip forming roller.

26. The system according to claim 21, wherein said first nip forming roller has a larger nominal diameter than said second nip forming roller, and said first nip forming roller is more compliant than said second nip forming roller.

27. The system according to claim 21, wherein said first and second nip forming rollers are prevented from being independently repositionable with respect to said belt support member during fusing operations.

28. The system according to claim 20, further comprising a release mechanism operatively configured to adjust said belt support member relative to said fusing member.

29. The system according to claim 20, wherein said fusing member comprises:

a core;

a heating element positioned so as to supply heat to said fusing region; and at least one compressible layer formed about said core.

30. The system according to claim 29, wherein said core comprises a metal core having a nominal wall thickness in the range of 0.25 millimeters to 1.5 millimeters.

31. A fusing system comprising:

a rotatable fusing member;

a backup belt assembly; and a release mechanism arranged to selectively reposition said backup belt assembly between a first position wherein said backup belt is urged against said fusing member so as to define said fusing region at the nip therebetween, and a second position wherein said backup belt assembly is released from said rotatable fusing member, wherein said backup belt assembly comprises a belt support member having first and second belt tracking surfaces;

first and second nip forming rollers supported by said belt support member so as to be rotatable with respect thereto, wherein said first and second nip forming rollers are prevented from being independently repositionable with respect to said belt support member during fusing operations; and a backup belt disposed about said belt support member such that rotation of said backup belt, effected by contact between a moving surface of the rotatable fusing member and a surface of the backup belt, causes corresponding rotation of said first and second nip forming rollers and further causes said backup belt to slide about said belt support member with respect to said first and second belt tracking surfaces.

32. The fusing system according to claim 31, wherein said release mechanism is maintained in said second position during idle times of a corresponding electrophotographic device.

33. The fusing system according to claim 31, wherein said release mechanism is operatively configured to transition said backup belt assembly from said second position to said first position during fusing operations, and return said backup belt assembly to said second position subsequent to fusing operations.

34. The fusing system according to claim 31, wherein said release mechanism is maintained in said first position during fusing operations but is moved to said second position upon an occurrence of a media jam.

* * * * *